US012241346B1

(12) United States Patent
Greci et al.

(10) Patent No.: US 12,241,346 B1
(45) Date of Patent: Mar. 4, 2025

(54) REMOTELY OPERATED THREE POSITION SPOOL VALVE

(71) Applicant: Halliburton Energy Services, Inc., Houston, TX (US)

(72) Inventors: Stephen Michael Greci, Little Elm, TX (US); Ryan W. McChesney, Prosper, TX (US); Michael Linley Fripp, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/499,698

(22) Filed: Nov. 1, 2023

(51) Int. Cl.
*E21B 43/12* (2006.01)
*E21B 34/10* (2006.01)

(52) U.S. Cl.
CPC ..... *E21B 43/123* (2013.01); *E21B 34/10* (2013.01); *E21B 2200/02* (2020.05)

(58) Field of Classification Search
CPC ..... E21B 34/08; E21B 34/10; E21B 2200/02
See application file for complete search history.

(56) References Cited

U.S. PATENT DOCUMENTS 5,004,050 A * 4/1991 Sizonenko ..... G01V 1/157 166/248
11,143,003 B2 10/2021 Novelen et al.
11,549,342 B2 1/2023 Greci et al.
2004/0226720 A1 11/2004 Schultz et al.
2016/0215595 A1 7/2016 Lopez et al.
2017/0247988 A1* 8/2017 Hardesty ..... E21B 43/119
2017/0328155 A1* 11/2017 Richards ..... E21B 47/06
2021/0140255 A1 5/2021 Greci et al.
2021/0348478 A1* 11/2021 Novelen ..... E21B 34/14
2021/0404297 A1 12/2021 Greci et al.
2022/0195842 A1* 6/2022 Werkheiser ..... E21B 23/04
2023/0003106 A1* 1/2023 Conzemius ..... E21B 47/095
2023/0212925 A1 7/2023 Inglis

OTHER PUBLICATIONS

International Search Report and Written Opinion dated Jul. 23, 2024 for related PCT Application No. PCT/US2023/079559 filed Nov. 14, 2023.

* cited by examiner

*Primary Examiner* — Shane Bomar
(74) *Attorney, Agent, or Firm* — K&L Gates LLP

(57) ABSTRACT

A spool valve assembly and methods for use downhole to control fluid flow into a borehole from a downhole formation. The assembly includes a valve body having an interior. The assembly also includes a spool moveable within the valve body interior from a first position wherein the spool prevents flow through the valve body, to a second position wherein the spool allows flow through the valve body at a first flow rate, and to a third position wherein the spool allows flow through the valve body at a second flow rate different than the first flow rate. The spool is moveable from the first position to the second position using hydrostatic fluid pressure acting on the spool from outside the valve body. The spool is moveable from the second position to the third position using gas pressure from a chemical reaction producing a force sufficient to overcome the hydrostatic pressure.

20 Claims, 6 Drawing Sheets

REMOTELY OPERATED THREE POSITION SPOOL VALVE

BACKGROUND

Well completion is the stage of oil and gas borehole preparation after the drilling to prepare the well to produce oil or gas from a reservoir or formation that the well is dug into. It can include several operations including cementing and installing various components and equipment, e.g., production tubing, casings, pumps, and washing tubes, as well as other operations such as setting packers, perforating strings and/or the formation, fracturing the formation to increase permeability of the reservoir, and undertaking testing prior to production of oil or gas.

A gravel packing operation is also sometimes performed prior to commencement of a hydrocarbon production operation to reduce the amount of unwanted formation sand that may flow into downhole strings (such as production tubing) that are deployed in the borehole during the hydrocarbon production operation. During a gravel packing operation, a fluid containing a gravel pack slurry is pumped into a production zone of the borehole. After the gravel pack slurry is pumped into the production zone, the gravel pack slurry is dehydrated to form gravel packs around future production regions and to inhibit sand flow into the downhole strings. Typically, gravel packing operations may involve placing a gravel pack screen in the borehole and packing the surrounding annulus between the screen and the borehole with gravel designed to prevent the passage of formation sands through the pack. Such gravel packs may be used to stabilize the formation while causing minimal impairment to well productivity. The implementation of a gravel pack may include running a completion assembly on a service tool downhole. The completion assembly may include a screen, shear sub, blank pipe, a packer assembly, and sump packer seal assembly. The packer may then be set and the completion assembly may be released from the packer when the gravel packing operation is complete.

After well completion, in the production phase, the production tubing brings up fluids from the rock formations containing oil and gas up to the surface. In some wells, casing is installed in the well and surrounds the tubing. The casing, the production tubing, or both can be perforated to allow the formation fluid to flow through and into the casing or production tubing. When well completion operations or production operations are performed, there may be different requirements of fluid flow rates into or out of the production tubing. In some operations, the perforations of the tubing and/or the casings need to be completely sealed, while some operations require a restricted flow rate, and in others to allow unrestricted fluid flow. However, traditional systems and methods of flow rate regulation are labor intensive, time-consuming, and rely on complicated equipment or installations.

BRIEF DESCRIPTION OF THE DRAWINGS

Aspects of the disclosure are described with reference to the following figures, the features of which are not necessarily shown to scale. Some details of elements may not be shown or may be represented by conventional symbols in the interest of clarity and conciseness.

DETAILED DESCRIPTION

Disclosed herein are remotely-operable spool valve assemblies, methods, and systems to regulate the flow of substances in and out of borehole strings, including production tubing with variable flow rates as required by well completion production operations. The systems and methods disclosed herein utilize multi-position spool valve-based flow regulation that can completely eliminate the need for wash pipes, setting packers, and other types of sealing of flow regulation methods in boreholes.

In a general aspect, the disclosed embodiments are directed to a spool valve assembly that can be placed along a portion of the length of production tubing to regulate the flow rate of fluid into or out of the production tubing, including treatment or process fluids out of the production tubing or the oil and gas into the production tubing from a formation. The spool valve assembly is generally pre-installed at a specific portion of a length of the production tubing to cover a perforated area where fluid flows into or out of the tubing before the tubing is sent downhole.

The spool valve assembly comprises multiple exit ports, which can be closed or opened in various different combinations based on a positioning of a spool inside a valve body. By utilizing pneumatic and external hydrostatic pressure, the spool is moved to block or unblock different combinations of exit ports to block or alter the rate of fluid flow through the spool valve assembly. This allows operators of well completions to be able to control the rate of flow into or out of the production tubing based on the needs of the current operation being performed.

Figure 1:
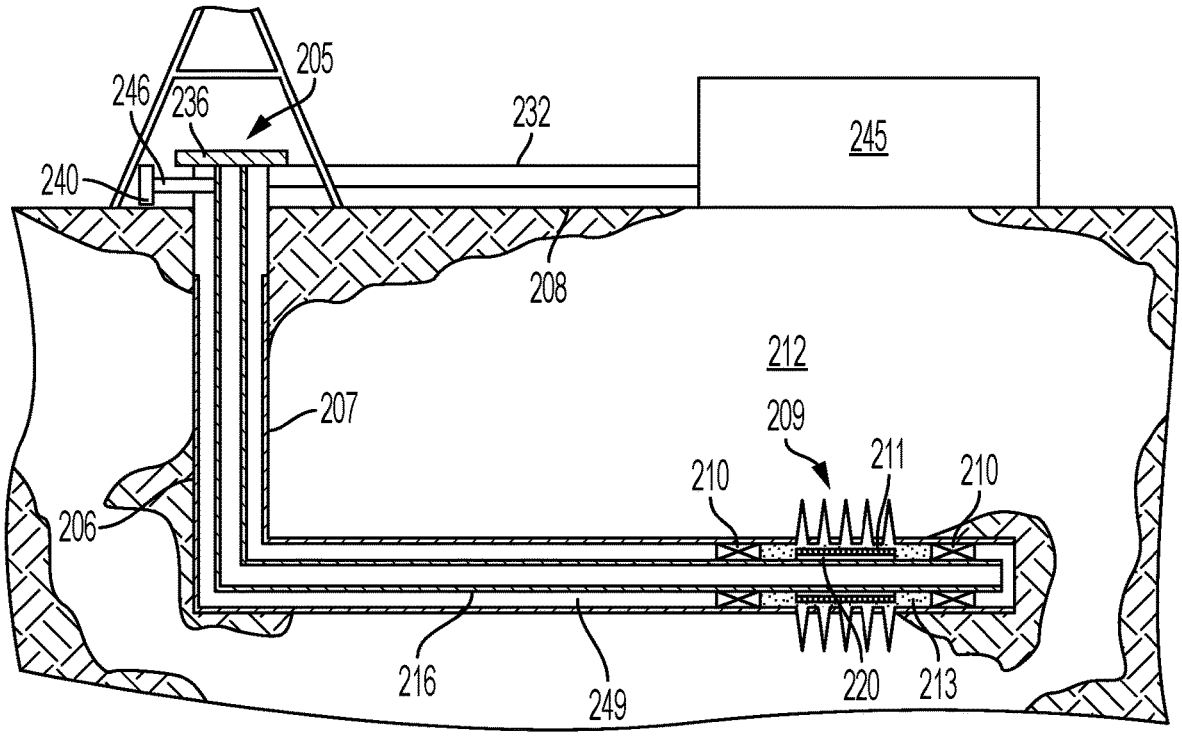
FIG. 1 is a schematic, side view of a borehole during well completion, according to at least one aspect of the present disclosure.

FIG. 1 is a schematic, side view of a borehole during well completion operations, according to at least one aspect of the present disclosure. In the embodiment presented in FIG. 1, a well 205 has a borehole 206 that extends from a surface 208 of the well 205 to or through the formation 212. At least a portion of the borehole 206 is lined with a casing 207, which has been perforated to include perforations 209 at or near a production zone. A production tubing 216, with at least one and possibly more than one spool valve assembly 220 installed on a portion of its length, is lowered down the borehole 206 such that the spool valve assembly 220 is near the perforations 209. Although the embodiment shown in FIG. 1 includes production tubing, one of ordinary skill in the art would appreciate the spool valve assembly 220 may also be used on other downhole strings, e.g., coiled tubing, drill pipe, or any other type of string. Although not illustrated, the production tubing 216 may include various tubular types and downhole tools (e.g., screens, valves, isolation devices, etc.) used to perform a variety of downhole operations especially as related to well completion and well production.

The well 205 also includes a wellhead 236 and an inlet conduit 232 coupled to a fluid source 245 (e.g., a vehicle or tanker). The inlet conduit 232 provides a fluid passageway for fluids, such as hydraulic fracturing fluid, washing fluid, mud, or other fluids or substances for cementing, for gravel pack slurry, to flow from the fluid source 245 to the production tubing 216, or alternatively to provide pressure or pressurized fluids and/or substances into the production tubing 216. Moreover, the production tubing 216 provides a conduit for fluids, such as gravel pack slurry and carrier fluids, to flow from the surface 208 downhole and to deliver oil and gas uphole and out of the borehole 206. In the embodiment of FIG. 1, fluids may flow from the production tubing 216 into an annulus 249 defined as the space between the borehole 206 and/or optional casing and the production tubing 216. The annulus 249 provides another fluid passageway for fluids to continue to flow uphole until the fluids exit the annulus 249, for example via one or more outlet conduit (s) 246. These fluids can ultimately be captured in container (s) 240. The production tubing 216 may include multiple conduits for flowing different types of fluids downhole and for flowing fluids uphole to the surface 208, such as oil or gas from a downhole location to the surface 208, which may also be captured in container(s) 240 via outlet conduit(s) 246.

Shown in FIG. 1 is an embodiment with the spool valve assembly 220 installed on at least one portion of a length of the production tubing 216. However, it should be appreciated that multiple spool valve assemblies 220 can be installed along the length of the production tubing 216. In one example the spool valve assemblies 220 may be installed at every 30 or 40 feet nearby set gravel packs. The portion of the spool valve assembly 220 that is installed may be placed on a perforated portion of the length of the casing 207, and the spool valve assembly 220 therefore can act as a regulator of flow into or out of the production tubing 216. As shown, a gravel packing operation has already been completed where packers 210 have been set in the annulus 249 between the production tubing 216 and the casing 207. Surrounding the production tubing 216 and enclosing the spool valve assembly 220 is a gravel packing screen 211. A gravel pack 213 has been installed outside of the gravel packing screen 211 between the packers 210 to filter fluids travelling between the formation 212 and the production tubing 216.

The production tubing 216 may also contain or be used as an installation for communication lines to transmit signals, such as control signals or sensor signals related to measuring temperature, pressure, or any other type of downhole measurement to or from the spool valve assembly 220. The spool valve assembly 220 can utilize the control signals to activate or trigger one or more of the components of the spool valve assembly 220. The production tubing 216 may also be used to provide or to mount conduits for providing power to the spool valve assembly 220 via wiring, or via other types of energy sourcing such as batteries that can be connected to the spool valve assembly 220.

Figure 2:
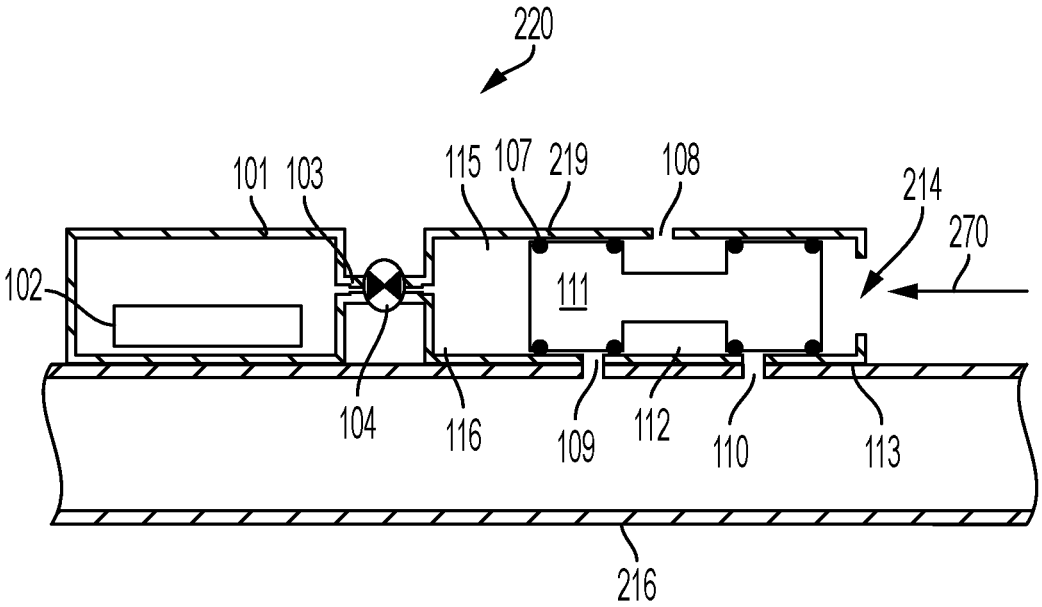
FIG. 2 is a schematic cross-sectional view of a spool valve assembly installed on a portion of a length of a string during oil completion operations, according to at least one aspect of the present disclosure.

FIG. 2 is a cross-sectional view of an embodiment of a spool valve assembly 220 attached to the production tubing 216 during well completion or well production, according to at least one aspect of the present disclosure. The spool valve assembly 220 can be preconfigured or programmed to manage the flow rate of fluid into or out of the production tubing 216 depending on the current running well completion or well production operation. The spool valve assembly 220 is shown in FIG. 2 in a first position. The spool valve assembly 220 includes two parts, a reactive metal enclosure 101, the interior of which is a reactive metal chamber, and a valve body 219 comprising an interior that contains a spool 111 movable within the interior of the valve body 219. The valve body 219 also includes at least one inlet port 108, at least one first exit port 109, and at least one exit port 110. In various embodiments, ports 108-110 comprise only a portion of available or possible plurality of ports in the valve body 219.

The spool 111 includes two lands sealed against the interior wall of the valve body 219 and connected by a spool core. The outer surface of the lands may form a seal or alternatively seals may be included on the outer surfaces of the lands. Such seals may include o-rings or other silicone based seals or mechanical seals that are placed on various locations on the spool 111 to ensure proper sealing. The lands separate the interior of the valve body 219 into a reactive fluid chamber 116, an interior chamber 112, and an open chamber 113, the open chamber 113 being open to the hydrostatic pressure through an opening 214. The interior chamber 112 is where fluid flows into the spool valve assembly 220 from the formation and where fluid flows out of the spool valve assembly 220 into the production tubing 216 via at least one of exit ports 109, 110. For conciseness, the ports 108-110 are labeled as "entry" and exit" with respect to flow from the formation 212 into the production tubing 216 through the spool valve assembly 220. However, it should be appreciated that flow can also occur from the production tubing 216 and out into the formation 212 through the spool valve assembly 220. In such a case of outflow, the inlet port 108 would actually function as an "outlet" and the two exit ports 109 and 110 would function as "inlets." However, for clarity, the ports 108-110 will be labeled and described with respect to flow into the production tubing 216.

The interior of the reactive metal enclosure 101 is connected in fluid communication with the reactive fluid chamber 116 via a reactive fluid channel 103. Further, a reactive metal 102 is located in the interior of the reactive metal enclosure 101. The reactive metal 102 can include but is not limited to, magnesium, calcium, aluminum, zinc, iron, potassium, sodium, or any combination of reactive metals. Examples of suitable metal alloys for the reactive metal include, but are not limited to, alloys of magnesium, calcium, aluminum, zinc, iron, potassium, sodium, or any combination of reactive metals and/or alloys. Metal alloys also include alloys of magnesium-zinc, magnesiumaluminum, or calcium-magnesium. In some examples, the metal alloys may comprise alloyed elements that are not metallic. Examples of these non-metallic elements include, but are not limited to, graphite, carbon, silicon, boron nitride, and the like. In some examples, the metal is alloyed to increase or decrease reactivity and/or to control the formation of oxides and hydroxides. In other examples, the metal is heat treated to control the size and shape of the oxides and hydroxides including precipitation hardening, quenching, and tempering. In some examples, the metal alloy is also alloyed with a dopant metal that promotes corrosion or inhibits passivation and thus increases the rate of the gas and hydroxide formation. Examples of dopant metals include, but are not limited to, nickel, iron, copper, carbon, titanium, gallium, mercury, cobalt, iridium, gold, palladium, or any combination thereof. In another example, particles of the metal are coated with the dopant, and the coated metal powder is pressed and extruded to create the metal alloy.

In some optional examples, the reactive metal may include a removable barrier coating. The removable barrier coating may be used to cover the exterior surfaces of the reactive metal 102 and isolate the reactive metal. The removable barrier coating may be removed when a reaction is to occur. The removable barrier coating may be used to delay the reaction and/or prevent a premature reaction. Examples of the removable barrier coating include, but are not limited to, any species of plastic shell, elastomeric shell, organic shell, metallic shell, anodized shell, paint, dissolvable coatings (e.g., solid magnesium compounds), eutectic materials, or any combination thereof. When desired, the removable barrier coating may be removed from the reactive metal with any sufficient method. For example, the removable barrier coating may be removed through dissolution, a phase change induced by changing temperature, corrosion, hydrolysis, the degradation of the support of the barrier coating, or the removable barrier coating may be time-delayed and degrade after a desired time under specific borehole conditions.

The interior of the reactive metal enclosure 101 can be at ambient surface pressure of 14.4 PSI (99284.51 Pa) or it can be vacuumed to below 14.4 PSI (99284.51 Pa) when assembled so as to be in the range of 0 PSI (0 Pa) to 14.4 PSI (99284.51 Pa) at assembly. Further, located in the reactive fluid channel 103 is a remotely operable and activated channel valve 104, which can be but is not limited to a solenoid valve. It is to be understood than any suitable closeable valve can be used. The channel valve 104 can be in at least two positions or states, a closed/locked state and open/released state, where the closed/locked state prevents any flow between the reactive fluid chamber 116 and the interior of the reactive metal enclosure 101. In various embodiments, intermediary stages are also available for the channel valve 104, which allows the channel valve 104 to meter and control the amount of fluid flow in the channel 103. The channel valve 104 may be activated automatically and/or remotely, for example via a control circuit.

The reactive fluid chamber 116 of the valve body 219 contains a reactive fluid 115 prevented from entering the other sections of the interior of the valve body 219 by the spool 111. In general, the type of reactive fluid 115 may be selected on the temperature range at which the spool valve assembly 220 is expected to operate as well as the reactive metal 102 the reactive fluid 115 will chemically react with as explained further below. For example, the reactive fluid 115 can comprise but is not limited to saltwater (e.g., water containing one or more salts dissolved therein), brine (e.g., saturated saltwater, which may be produced from subterranean formations), seawater, freshwater, or any combination thereof. Generally, the reactive fluid may be from any source provided that the fluid does not contain an excess of compounds that may undesirably affect other components in the spool valve assembly 220. In the case of saltwater, brines, and seawater, the reactive fluid 115 may comprise a monovalent salt or a divalent salt. Suitable monovalent salts may include, for example, sodium chloride salt, sodium bromide salt, potassium chloride salt, potassium bromide salt, and the like. Suitable divalent salt can include, for example, magnesium chloride salt, calcium chloride salt, calcium bromide salt, and the like. In some examples, the salinity of the reactive fluid 115 may exceed 10%. In some examples, the density of the reactive fluid may exceed 8.5 pounds per gallon. Advantageously, the reactive metal 102 of the present disclosure may not be impacted by contact with high-salinity fluids.

In some optional examples, the reactive fluid 115 may comprise an acid. The acid may be mixed with the general aqueous fluids described above, such as a brine. The acid may help maintain the reactive metal reactant in solution and may help accelerate the reaction. Examples of acids generally include any organic or inorganic acid. Specific examples of acids may include, but are not limited to, citric acid, hydrochloric acid, succinic acid, sulfamic acid, adipic acid, lactic acid, or any combination of thereof.

As discussed above in relation to FIG. 1, the production tubing 216 can include perforations 204 for the ingress of substances such as oil and gas and/or other fluids or gases. The spool valve assembly 220 is installed along a length of the production tubing 216 and in alignment with the perforations 204, and is in a first position as shown in FIG. 2, to allow fluid flow into or out of the spool valve assembly 220 through the perforations 204. In embodiments, the default setting of the spool 111 is to be positioned in the first position that blocks the spool valve assembly 220's exit ports 109, 110, preventing any egress of substances from the spool valve assembly 220 into the production tubing 216. The exit ports 109, 110 can include any number or combination of each of high flow rate exit ports 109, and low flow rate exit port(s) 110.

High and low are relative terms with respect to the comparison of the flow rate allowed through each exit port 109 compared to the different flow rate allowed through exit port 110, which is lower that the flow rate through exit port 109 due to the high flow exit port 109 having a larger size than the low flow exit port 110. In various embodiments, combinations of the plurality of ports blocked or exposed by the spool 111 can comprise any number or combination of any of the inlet port 108, the exit port 109, and the exit port 110. The position, number, and diameters/widths of the inlet port 108, the high flow first exit port 109 and the low flow second exit can be variable depending on the design and goals of the operation, where various design goals allow for innumerable possible combinations of inflow and outflow ports and flow rates. In one example, the high flow first exit port 109 can be ⅜ of an inch (9.525 mm) in diameter, while the low flow second exit port 110 can each be 0.25 inches (6.35 mm) in diameter, and the inlet port 108 can be for example, be 0.5 inches (12.7 mm) in diameter. In the example presented in FIG. 2, only one of each of the ports 108-110 are illustrated, however multiple of each of the ports 108-110 may be included. The spool 111 can also be repositioned in any location within the interior of the valve body 219 to cover or uncover any number or combination of flow ports, inlet or exits, to provide various combinations of substance flow rates through the spool valve assembly 220 as necessitated by current operational requirements. As an example, the low flow rate may be in the range of 0.5 to 5 gpm (31.6 to 315.5 $cm^3/s$) at 100 psi (689.5 kPa). As an example, the high flow rate may be in the range of 5 gpm to 30 gpm (315.5 to 1892.7 $cm^3/s$) at 100 psi (689.5 kPa). Additionally, the low flow rate may be designed to create a pressure drop across the spool valve assembly 220 to help balance the flow into the production tubing 216 throughout the well 205 when used in conjunction with inflow control devices (ICDs). Alternatively, the low flow rate may selected for use with autonomous inflow control devices (AICDs) once an unwanted fluid enters the AICDs.

In embodiments, the spool valve assembly 220 can comprise one or more sensors (not shown). The sensors can include but are not limited to temperature sensors, gas sensors, depth sensors, pressure sensors, or light sensors (collectively referred to herein as "sensor" or "sensors"). In embodiments, the spool valve assembly 220 also comprises a control circuit operable to actuate the channel valve 104 in response to preprogrammed instructions, timers, battery or capacitor charge, a manually generated signal, and/or data or one or more signals from the one or more sensors of the one or more listed types. In embodiments, the spool valve assembly 220 can comprise a battery or capacitor to power/activate the channel valve 104 and/or power the control circuit. In embodiments, a flow of liquids and gases in the reactive fluid channel 103 may also be remotely controlled and adjustable, where the flow rate is controlled into and out of the channel 103. In embodiments, the control of the flow rate can occur by metering the valve 104 to close and open to different stages or levels, for example, by manually and remotely controlling the channel valve 104 to open to a specific level, allowing a specific flow rate to occur through the reactive fluid channel 103. In some aspects this could be done automatically based on pre-determined or programmed thresholds or in response to one or more signals from the one or more sensors of the one or more listed sensor types, for example in response to sensor(s) in the spool valve assembly 220. For example, after well completion is over, and well production begins, the valve 104 can be activated in response to one or more automatic signals from one or more sensors, timers, or a power source or the like to shift the spool 111 into a different position, to cover and uncover a different combination of inlet port 108, first exit port 109, and second exit port 110, thus changing the flow rate through the spool valve assembly 220.

Figure 3A:
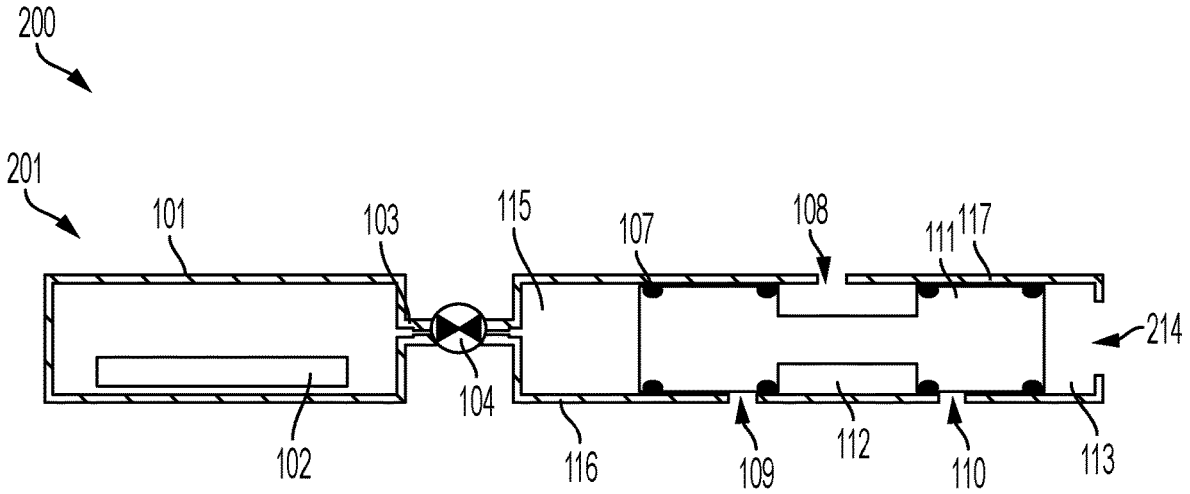
FIGS. 3A-3C illustrates the various positions of the spool valve assembly in various modes of operation, according to at least one aspect of the present disclosure.
Figure 3B:
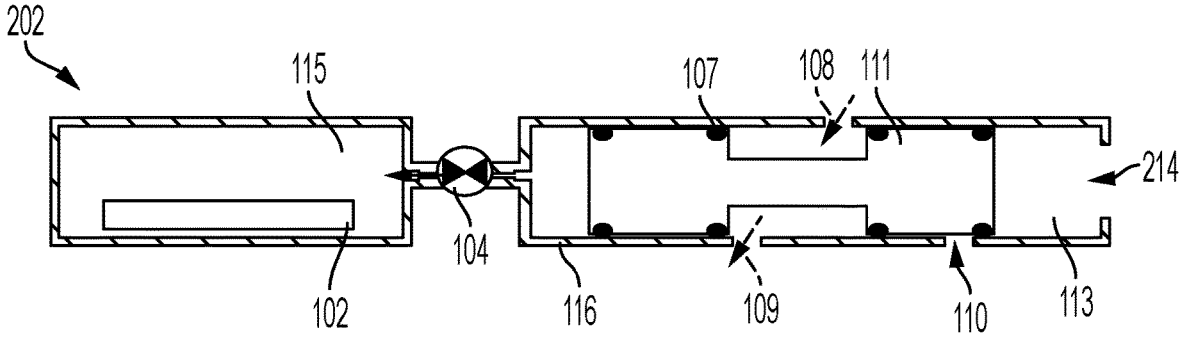
Figure 3C:
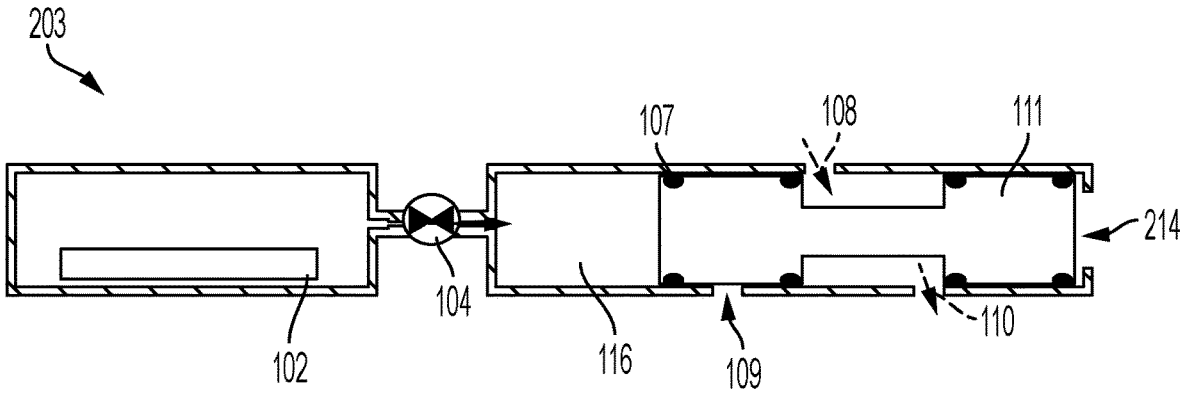

FIGS. 3A-3C illustrate positions of the spool 111 in the spool valve assembly 220 for various modes of operation, according to at least one aspect of the present disclosure. The spool valve assembly 220 is remotely operable to position the spool 111 in several different placements in the spool valve assembly 220 including but not limited to the positions illustrated in FIGS. 3A-3C. Example 200 presents three positions, the spool 111 in a first position 201, the spool 111 in the second position 202, and the spool 111 in a third position 203. These positions 201-203 are presented in FIGS. 3A-3C in a specific order, however it is to be understood that the order of operations can vary, and other positions may be added or modified based on the number and/or locations of inlet and exit ports in the spool valve assembly 220, metering adjustments made to the channel valve 104 to control flow in the reactive fluid channel 103, as well as various combinations of the reactive fluid 115 and the reactive metals 102 used.

As shown in FIG. 3A, the spool 111 is in a first position wherein the spool 111 prevents flow through the valve body 219 by blocking both of the exit ports 109 and 110. The spool is hydraulically locked in the first position by closing the channel valve 104, thus preventing fluid from flowing out of reactive fluid chamber through the reactive fluid channel 103. In embodiments, the spool 111 starts in the default first position 201. The spool 111 is placed in the first position 201 at the surface before the spool valve assembly 220 is deployed into the borehole 206. In the first position 201, the reactive fluid 115 is in the reactive fluid chamber 116, and the reactive metal 102 is in the interior of the reactive metal enclosure 101, and the channel valve 104 is in a closed position.

The spool valve assembly 220 is sent down the borehole 206 to be placed on the production tubing or is pre-installed on the production tubing 216 and sent down with the production tubing 216. The spool valve assembly 220 at this stage is in a no flow position, i.e., the first position 201, where the inlet port 108 may be uncovered, but with the spool 111 covering both the high flow first exit port 109 and the low flow second exit port 110, preventing any fluid flow through the spool valve assembly 220, to prevent any substance from getting into the production tubing 216. This for example is useful when foregoing the use of a wash pipe. The pressure in the interior of the reactive metal enclosure 101 can be 14.4 PSI (99284.51 Pa) if the enclosure 101 is sealed at atmospheric air pressure, but could be anywhere from 0-14.4 PSI (0-99284.51 Pa) if the interior of the enclosure 101 is vacuumed before being deployed down the borehole 206. The pressure, for example the external environmental hydrostatic pressure 270, depends on the pressure of the environment the spool valve assembly 220 is surrounded by and placed in. In boreholes, these pressures could generally range from 4000-20000 PSI (27579 kPa-137895 kPa) or more, for example, if the pressure at a first distance down a borehole is 5000 PSI (34473 kPa), this pressure would act on the open chamber 113 and thus the spool 111, which would in turn pressurize the reactive fluid 115 in the reactive fluid chamber 116. However, with the channel valve 104 closed, the spool 111 is held in the first position, preventing any reactive fluid 115 from entering the interior of the reactive metal enclosure 101.

At a pre-programmed depth, time, temperature, or pressure, battery or capacitor charge, or in response to a manually generated signal, or any combination thereof, any of these variables being determinable by one or more sensors of one or more types, the control circuit activates the channel valve 104 to move to an open position and allow fluid communication through the reactive fluid channel 103. The opening of the channel valve 104 can occur by time and/or temperature codes and can happen relatively quickly in the life of well, within a short time frame that batteries of the spool valve assembly 220 can survive. In one example, the spool valve assembly 220 can include temperature sensors that sense and detect temperatures, and because bottom hole temperature of a well is known, a circuit board of the spool valve assembly 220 can be pre-programmed to a specific temperature or temperature range where the channel valve 104 will open and/or close, in addition a timing can be programmed to activate the channel valve 104 within the passage of a few hours of detecting the temperature or temperature range. Also, if temperature patterns can also be detected and recognized such as a drop then rise of temperature in addition to time combinations to activate the channel valve 104. Various combinations of variables can be used in tandem including and not limited to pressure and times, temperature and time, temperature and pressure, and the like to activate or cause deactivation of the valve 104.

Opening the channel valve 104 allows the pressurized reactive fluid 115 to flow into the interior of the reactive metal enclosure 101, depressurizing the reactive fluid chamber 116, and allows the spool 111 to be pushed by the external environmental hydrostatic pressure 270 into the second position 202. The depressurization of reactive fluid chamber 116 as the reactive fluid 115 flows into the reactive metal enclosure 101 may also cause a vacuum effect that pulls the spool 111 towards the enclosure 101, setting the spool 111 into the second position 202. Optionally, seals or stabilizers 107 could click into grooves in the interior wall of the valve body 219 and hold the spool 111 in place in the second position. Setting the spool 111 into the second position 202 could occur for example after the completion of setting packers and while performing a gravel pack or clean-up operation. The second position in this example is a high flow position, where the high flow first exit port 109 is uncovered by the spool 111 and the low flow second exit port 110 is covered by the spool 111, allowing fluid to flow at a high flow rate from the production tubing 216 and out through the spool valve assembly 220, such as out into the formation 212.

When opened, the channel valve 104 may be pre-programmed to open for a pre-defined time period, or may be unlocked/locked for a period or based upon a signal produced by any combination of the one or more sensors described herein. For example, a pressure sensor may detect a change in pressure in the reactive fluid chamber 116 as the spool 111 moves into the second position 202, and based on the change of pressure, the control circuit closes the valve 104. Otherwise the valve 104 may have a default time for which it is open that does not change, or is activated at certain pre-programmed times.

With the reactive fluid 115 in the interior of the reactive metal enclosure 101, the reactive fluid 115 chemically reacts with the reactive metal 102 to produce a reactive product gas that fills and increases the pressure in the interior of the enclosure 101, since the valve 104 is closed, and gas has no means of escape. Once the position of the spool 111 needs to be changed from the second position 202 to a third position 203, for example, when the spool valve assembly 220 needs to allow the production of fluids from the formation 212 into the production tubing 216, such as through inflow control devices (ICDs) or autonomous inflow control devices (AICDs), the control circuit once again opens the channel valve 104. Opening the channel valve 104 allows the pressurized gas that has reached a pneumatic pressure exceeding the hydrostatic pressure 270 acting on the spool 111 through the opening 214 to flow out of the interior of the enclosure 101, through the channel 103, and into the reactive fluid chamber 116. The pneumatic pressure from the pressurized gas pushes the spool 111 toward the opening 214 to a third position 203. The channel valve 104 can be activated based on automated pre-programming, for example, based on time or a battery/capacitor charge level, on data received from the various sensors based on pressure, temperature, and/or from any other sensor associated with the spool valve assembly 220. Setting the spool 111 into the third position 203 could occur for example after the completion of a borehole completion operation such as performing a gravel pack or clean-up operation. The third position in this example is a low flow position, where the high flow first exit port 109 is covered by the spool 111 and the low flow second exit port 110 is uncovered by the spool 111, allowing fluid to flow at a low flow rate from the formation 212, in through the spool valve assembly 220, and into the production tubing 216.

Figure 4:
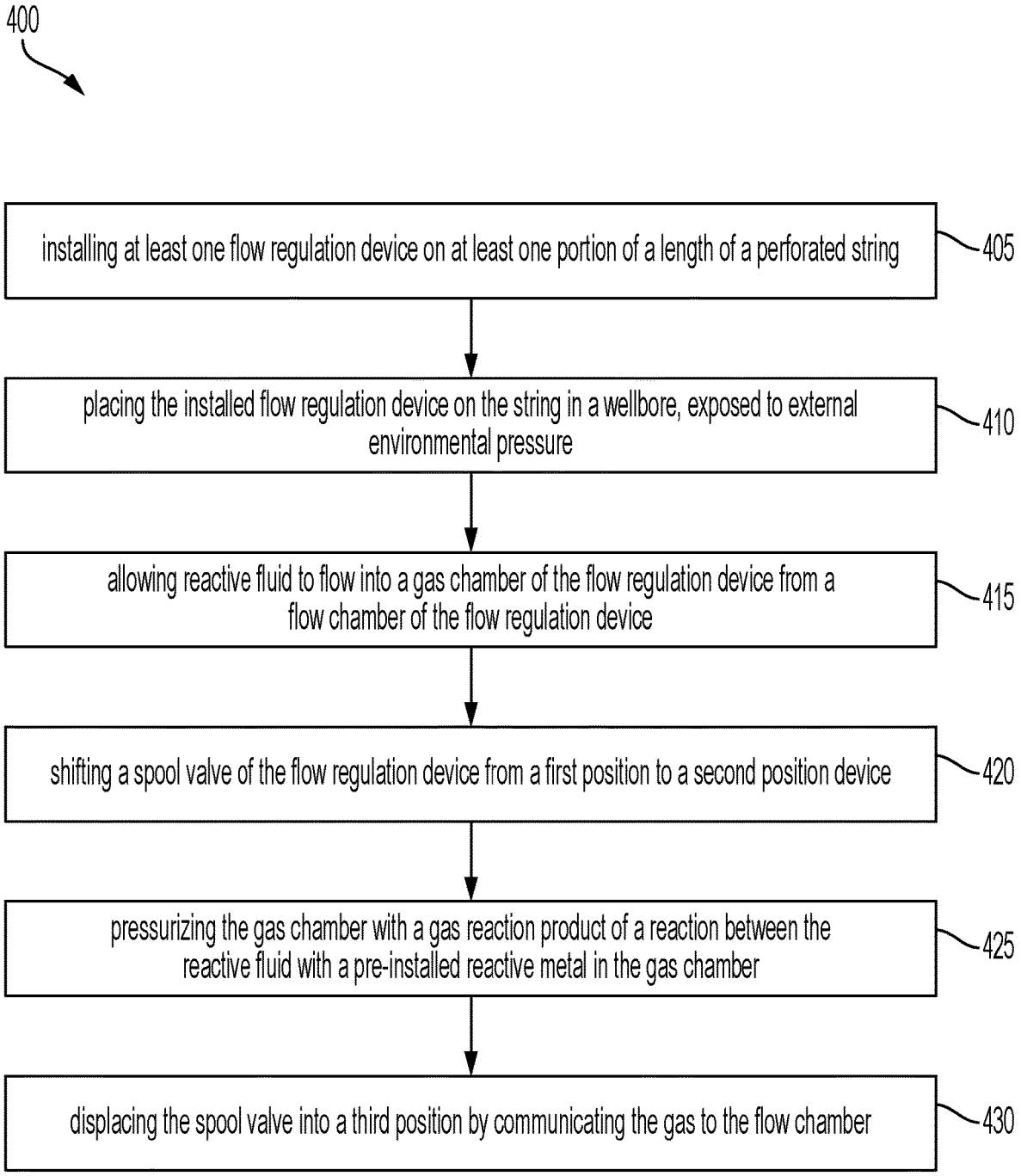
FIG. 4 illustrates a block diagram of a method of regulating flows in and out of production tubing via the flow regulation device, according to at least one aspect of the present disclosure.

FIG. 4 illustrates a block diagram of a method 400 of regulating flows in and out of production tubing in an oil well via a flow regulation device, according to at least one aspect of the present disclosure. It is to be understood that while method 400 can comprise a variety of processes as illustrated in blocks 405-430, all of the disclosed blocks are optional and can be removed or altered. Furthermore, the order of blocks 405-430 are interchangeable and do not have to be practiced in the order disclosed herein.

Referring primarily to FIG. 4, in combination with FIGS. 1-3C, the method 400 can commence by installing, at 405, at least one flow regulation device, e.g., spool valve assembly 220 shown in FIG. 2, on at least one portion of a length of a perforated string, e.g., the production tubing 216 with the flow regulation device in a first position. The method 400 may continue with placing the installed spool valve assembly 220 on the string in a borehole, e.g., the borehole 206. The spool valve assembly 220 is exposed to external environmental pressure, for example, external environmental pressure 270. The first position comprises positioning a spool valve, e.g., the spool 111, in a first position that blocks fluid flow through the flow regulation device by blocking flow through at least one port to prevent flow through the spool valve assembly 220. Additionally, a reactive fluid 215, in a reactive fluid chamber 116, of the interior chamber 112, is blocked from flowing into a reactive metal enclosure 101 by closing a valve, such as the channel valve 104.

The method 400 continues with allowing, at 415, the reactive fluid, e.g., reactive fluid 215, to flow into a gas chamber, e.g., reactive metal enclosure 101, of the at least one spool valve assembly 220 from a flow chamber, e.g., the reactive fluid chamber 116 of the flow regulation device via a channel, such as channel 103. This could be done for example by opening the channel 103 that connects reactive metal enclosure 101 and the reactive fluid chamber 116. Channel 103 can be opened by actuating a valve, such as the valve 104, which may be a solenoid valve. This may be done remotely, manually by an operator, or it may be done automatically. For example, the valve 104 may be actuated based on a signal, wherein the signal can comprise a signal from at least one of a temperature sensor, a pressure sensor, a gas sensor, or a timer, or a manual activation, or any combination thereof. The valve may also be actuated for example by a control circuit, based on a signal from a signal source such a sensor, battery, or processing device. The signal source can comprise at least one of a temperature sensor, a timer, a pressure sensor, a depth sensor, a gas sensor, a battery, or a capacitor.

After reactive fluid is allowed to enter the gas chamber e.g., the reactive metal enclosure 101, a first power source such as the external environmental pressure, e.g., 270, and/or a vacuum created by the reactive fluid escaping into the reactive metal enclosure shifts, at 420, a spool valve, e.g., spool 111, into a second position from a first position. With the opening of the valve 104 and movement of the spool 111 to the second positon, the reactive fluid enters the gas chamber. When the reactive fluid enters the gas chamber, the valve 104 is actuated to close and prevent the flow of fluid through the channel 103. The valve 104 may be actuated automatically, for example after a period of time, or by a signal received from a sensor such as a temperature sensor, pressure sensor, or gas sensor. Further, the shifting of the spool valve into the second position establishes flow through the flow regulation device by exposing at least one high flow exit port, e.g., exit port 109, to allow substances, such as oil and gas, to flow through the flow chamber, e.g., the interior chamber 112 shown in FIGS. 2 and 3, and exit the spool valve assembly 220 at a first flow rate, when the spool 111 is in the second position.

The reactive fluid in the gas chamber reacts with the reactive metal, such as the reactive metal 102, producing a gaseous reaction product, which pressurizes, at 425, the gas chamber. Once the gas chamber is sufficiently pressurized, which could be detected or determined by a pressure sensor in reactive metal enclosure 101, the valve 104 may again be actuated to open when desired. For example, the valve 104 may be actuated in response to preprogrammed instructions, timers, battery or capacitor charge, a manually generated signal, and/or data or one or more signals from the one or more sensors of the one or more listed types.

Once it is desired, or an automatic trigger threshold is reached, for example to activate the valve, to shift the spool valve to a third position, the valve is opened to allow for displacing, at 430, of the spool valve into a third position using a second power source, which is different than the first power source. For example, the second power source can include communicating gas from the reactive metal enclosure 101 to the reactive fluid chamber 116. This communication of gas is possible when the pressure in the reactive metal enclosure exceeds the pressure from the reactive fluid chamber so that the communicated gas from the reactive metal enclosure 101 produces sufficient pneumatic pressure to displace, at 430, the spool valve into a third position by pushing the spool valve away from the reactive metal enclosure 101. Further, shifting the spool into the third position, e.g., the third position 203, exposes at least one low flow exit port, e.g., port 110, and closes the high flow exit port, e.g., exit port 109, to allow substances to flow through the interior chamber 112 and exit the spool valve assembly 220 at a second flow rate that is lower than the first flow rate.

Figure 5:
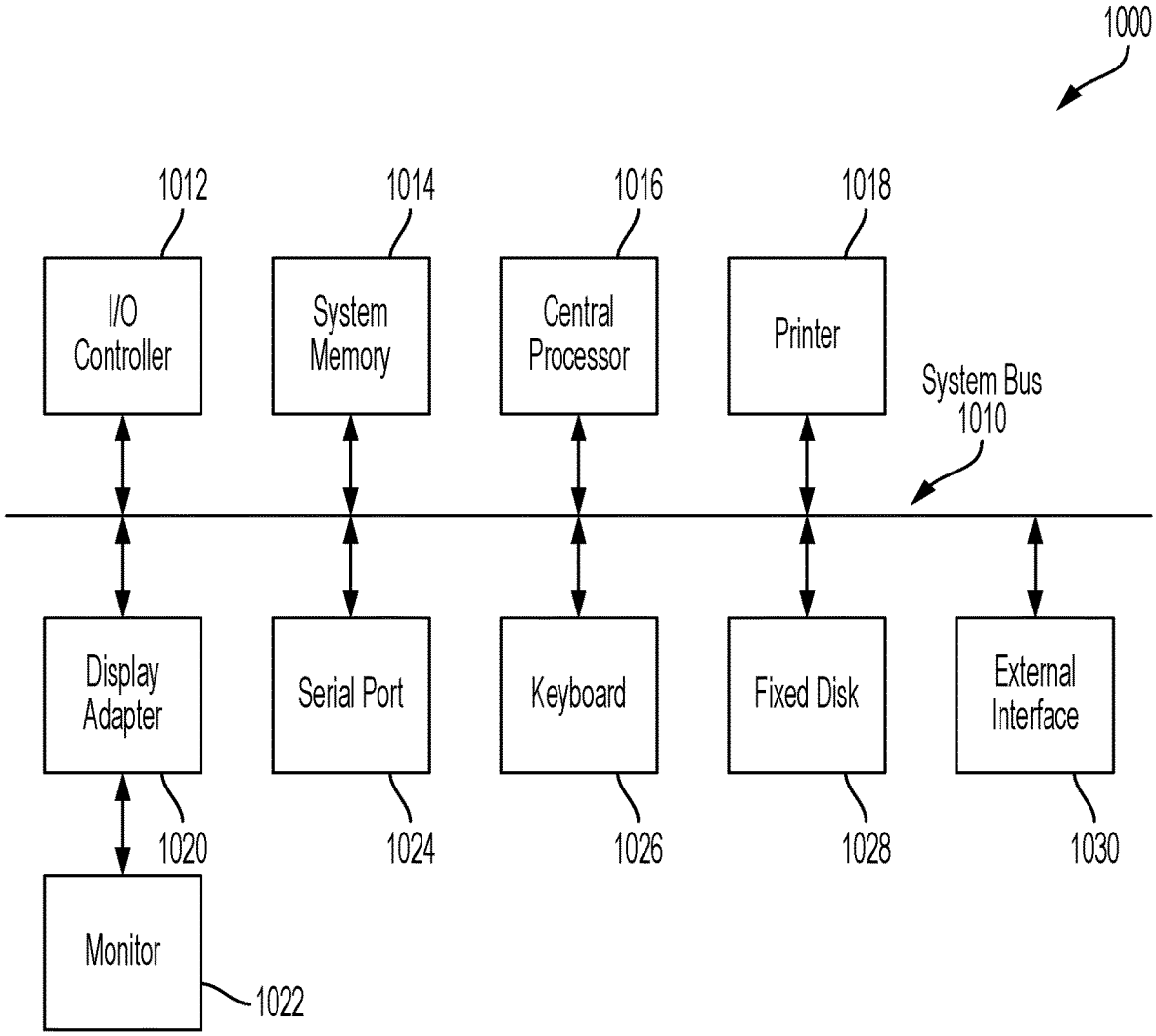
FIG. 5 is a block diagram of a computer apparatus with data processing subsystems or components, which can be used to program or activate a remote valve in the spool valve assembly, according to at least one aspect of the present disclosure.

FIG. 5 is a schematic diagram of a computer apparatus 1000 with data processing subsystems or components including a processor, which can be located downhole or at the surface and used to program or actuate the channel valve 104 in a spool valve assembly 220, according to at least one aspect of the present disclosure. The subsystems shown in FIG. 5 are interconnected via a system bus 1010. Additional subsystems such as a printer 1018, keyboard 1026, fixed disk 1028 (or other memory comprising computer readable media), monitor 1022, which is coupled to a display adapter 1020, and others are shown. Peripherals and input/output (I/O) devices, which couple to an I/O controller 1012 (which can be a processor or other suitable controller), can be connected to the computer system by any number of means known in the art, such as a serial port 1024. For example, the serial port 1024 or external interface 1030 can be used to connect the computer apparatus to a wide area network such as the Internet, a mouse input device, or a scanner. The interconnection via system bus allows the central processor 1016 to communicate with each subsystem and to control the execution of instructions from system memory 1014 or the fixed disk 1028, as well as the exchange of information between subsystems. The system memory 1014 and/or the fixed disk 1028 may embody a computer readable medium.

Examples of the above embodiments include:

Example 1 is a spool valve assembly for use downhole to control fluid flow into a borehole from a downhole formation. The assembly comprises: a valve body comprising an interior; and a spool moveable within the valve body interior from a first position wherein the spool prevents flow through the valve body, to a second position wherein the spool allows flow through the valve body at a first flow rate, and to a third position wherein the spool allows flow through the valve body at a second flow rate different than the first flow rate. The spool is moveable from the first position to the second position using hydrostatic fluid pressure acting on the spool from outside the valve body, and the spool is moveable from the second position to the third position using gas pressure from a chemical reaction producing a force sufficient to overcome the hydrostatic pressure.

In Example 2, the embodiments of any preceding paragraph or combination thereof further include wherein the second flow rate is less than the first flow rate.

In Example 3, the embodiments of any preceding paragraph or combination thereof further include: the valve body further comprising an inlet port, a first exit port allowing fluid flow at the first flow rate, and a second exit port allowing fluid flow at the second flow rate, wherein in a first position, the spool prevents flow through both the first and second exit ports, wherein in the second position, the spool allows fluid flow from the inlet port only through the first exit port, and wherein in the third position, the spool allows fluid flow from the inlet port only through the second exit port.

In Example 4, the embodiments of any preceding paragraph or combination thereof further include: the spool separating the interior into a reactive fluid chamber, an interior chamber, and an open chamber, the open chamber being open to the hydrostatic pressure; and a reactive metal enclosure comprising, the interior of which is a reactive metal chamber in fluid communication with the reactive fluid chamber through a reactive fluid channel, a reactive metal being located in the reactive metal chamber, wherein the spool is movable to the second position upon the hydrostatic pressure acting on the spool through the open chamber, which transfers a reactive fluid in the reactive fluid chamber into the reactive metal chamber, and wherein the spool is movable to the third position upon the reactive metal chemically reacting with the reactive fluid to produce a gas at a pressure communicated to the reactive fluid chamber sufficient to overcome the hydrostatic pressure acting on the spool.

In Example 5, the embodiments of any preceding paragraph or combination thereof further include a channel valve operable to control fluid flow through the reactive fluid channel.

In Example 6, the embodiments of any preceding paragraph or combination thereof further include wherein the spool is held in the first position by closing the channel valve and preventing the reactive fluid from flowing into the reactive metal chamber.

In Example 7, the embodiments of any preceding paragraph or combination thereof further include wherein the spool is moved to the second position by opening the channel valve and allowing the reactive fluid to flow from the reactive fluid chamber into the reactive metal chamber.

In Example 8, the embodiments of any preceding paragraph or combination thereof further include wherein the channel valve comprises a solenoid valve controllable based on at least one of time, temperature, or pressure.

In Example 9, the embodiments of any preceding paragraph or combination thereof further include wherein in the spool valve assembly is connected with a production tubing in the borehole and operable to: maintain the spool in the first position to prevent fluid flow though the spool valve assembly and into the production tubing or out into the downhole formation; move the spool into the second position to allow fluid flow from inside the production tubing out of the spool valve assembly or from the downhole formation into the production tubing at the first flow rate; and move the spool into the third position to allow fluid flow from inside the production tubing out of the spool valve assembly or from the downhole formation into the production tubing at the second flow rate.

Example 10 is a method of controlling fluid flow into a borehole from a downhole formation, the method comprising: installing a spool valve assembly downhole in the borehole, the spool valve assembly comprising a valve body comprising an interior and a spool moveable within the valve body interior; maintaining the spool in a first position to prevent fluid flow through the spool valve assembly; moving the spool to a second position using hydrostatic pressure acting on the spool from outside of the valve body to allow fluid flow through the spool valve assembly at a first flow rate; and moving the spool to a third position using gas pressure from a chemical reaction producing a force sufficient to overcome the hydrostatic pressure to allow fluid flow through the spool valve assembly at a second flow rate different than the first flow rate.

In Example 11, the embodiments of any preceding paragraph or combination thereof further include wherein the second flow rate is less than the first flow rate.

In Example 12, the embodiments of any preceding paragraph or combination thereof further include: preventing fluid flow through first and second exit ports of the valve body with the spool in the first position; allowing fluid flow into the valve body through an inlet port of the valve body and out of the valve body only through the first exit port with the spool in the second position; and allowing fluid flow into the valve body through the inlet port and out of the valve body only through the second exit port with the spool in the third position.

In Example 13, the embodiments of any preceding paragraph or combination thereof further include: separating the interior into a reactive fluid chamber, an interior chamber, and an open chamber with the spool, the open chamber being open to the hydrostatic pressure; transferring a reactive fluid in the reactive fluid chamber into a reactive metal chamber in fluid communication with the reactive fluid chamber through a reactive fluid channel by moving the spool to the second position; and chemically reacting the reactive fluid with a reactive metal in the reactive metal chamber to produce a gas at a pressure communicated to the reactive fluid chamber sufficient to overcome the hydrostatic pressure acting on the spool to move the spool to the third position.

In Example 14, the embodiments of any preceding paragraph or combination thereof further include operating a channel valve to control fluid flow through the reactive fluid channel.

In Example 15, the embodiments of any preceding paragraph or combination thereof further include holding the spool in the first position by closing the channel valve and preventing the reactive fluid from flowing into the reactive metal chamber.

In Example 16, the embodiments of any preceding paragraph or combination thereof further include moving the spool to the second position by opening the channel valve and allowing the reactive fluid to flow from the reactive fluid chamber into the reactive metal chamber.

In Example 17, the embodiments of any preceding paragraph or combination thereof further include wherein the channel valve comprises a solenoid valve controllable based on at least one of time, temperature, or pressure.

In Example 18, the embodiments of any preceding paragraph or combination thereof further include: installing the spool valve assembly to a production tubing in the borehole; maintaining the spool in the first position to prevent fluid flow though the spool valve assembly and into the production tubing or out into the downhole formation; moving the spool into the second position to allow fluid flow though the spool valve assembly and into the production tubing or out into the downhole formation at the first flow rate; and moving the spool into the third position to allow fluid flow though the spool valve assembly and into the production tubing or out into the downhole formation at the second flow rate.

Example 19 is a system for injecting fluids into and producing fluids from a downhole formation through a borehole extending through the formation, comprising: a production tubing in the borehole; a spool valve assembly connected with the production tubing and comprising: a valve body comprising an interior; and a spool moveable within the valve body interior from a first position wherein the spool prevents flow through the spool valve assembly and into the production tubing or out into the downhole formation, to a second position wherein the spool allows fluid flow though the spool valve assembly and into the production tubing or out into the downhole formation at a first flow rate, and to a third position wherein the spool allows fluid flow though the spool valve assembly and into the production tubing or out into the downhole formation at a second flow rate different than the first flow rate, wherein the spool is moveable from the first position to the second position using hydrostatic fluid pressure acting on the spool from outside the valve body, and wherein the spool is moveable from the second position to the third position using gas pressure from a chemical reaction producing a force sufficient to overcome the hydrostatic pressure.

In Example 20, the embodiments of any preceding paragraph or combination thereof further include: the spool separating the interior into a reactive fluid chamber, an interior chamber, and an open chamber, the open chamber being open to the hydrostatic pressure; and a reactive metal chamber in fluid communication with the reactive fluid chamber through a reactive fluid channel, a reactive metal being located in the reactive metal chamber, wherein the spool is movable to the second position upon the hydrostatic pressure acting on the spool through the open chamber, which transfers a reactive fluid in the reactive fluid chamber into the reactive metal chamber, and wherein the spool is movable to the third position upon the reactive metal chemically reacting with the reactive fluid to produce a gas at a pressure communicated to the reactive fluid chamber sufficient to overcome the hydrostatic pressure acting on the spool.

The foregoing detailed description has set forth various forms of the systems and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, and/or examples can be implemented, individually and/or collectively, by a wide range of hardware, software, firmware, or virtually any combination thereof. Those skilled in the art will recognize that some aspects of the forms disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as one or more program products in a variety of forms, and that an illustrative form of the subject matter described herein applies regardless of the particular type of signal bearing medium used to actually carry out the distribution.

Instructions used to program logic to perform various disclosed aspects can be stored within a memory in the system, such as dynamic random access memory (DRAM), cache, flash memory, or other storage. Furthermore, the instructions can be distributed via a network or by way of other computer readable media. Thus a machine-readable medium may include any mechanism for storing or transmitting information in a form readable by a machine (e.g., a computer), but is not limited to, floppy diskettes, optical disks, compact disc, read-only memory (CD-ROMs), and magneto-optical disks, read-only memory (ROMs), random access memory (RAM), erasable programmable read-only memory (EPROM), electrically erasable programmable read-only memory (EEPROM), magnetic or optical cards, flash memory, or a tangible, machine-readable storage used in the transmission of information over the Internet via electrical, optical, acoustical or other forms of propagated signals (e.g., carrier waves, infrared signals, digital signals, etc.). Accordingly, the non-transitory computer-readable medium includes any type of tangible machine-readable medium suitable for storing or transmitting electronic instructions or information in a form readable by a machine (e.g., a computer).

Any of the software components or functions described in this application, may be implemented as software code to be executed by a processor using any suitable computer language such as, for example, Python, Java, C++ or Perl using, for example, conventional or object-oriented techniques. The software code may be stored as a series of instructions, or commands on a computer readable medium, such as RAM, ROM, a magnetic medium such as a hard-drive or a floppy disk, or an optical medium such as a CD-ROM. Any such computer readable medium may reside on or within a single computational apparatus, and may be present on or within different computational apparatuses within a system or network.

As used in any aspect herein, the term "logic" may refer to an app, software, firmware and/or circuitry configured to perform any of the aforementioned operations. Software may be embodied as a software package, code, instructions, instruction sets and/or data recorded on non-transitory computer readable storage medium. Firmware may be embodied as code, instructions or instruction sets and/or data that are hard-coded (e.g., nonvolatile) in memory devices.

As used in any aspect herein, the terms "component," "system," "module" and the like can refer to a computer-related entity, either hardware, a combination of hardware and software, software, or software in execution.

Unless specifically stated otherwise as apparent from the foregoing disclosure, it is appreciated that, throughout the present disclosure, discussions using terms such as "processing," "computing," "calculating," "determining," "displaying," or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

Those skilled in the art will recognize that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flow diagrams are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

As used herein, the singular form of "a", "an", and "the" include the plural references unless the context clearly dictates otherwise.

In summary, numerous benefits have been described which result from employing the concepts described herein. The foregoing description of the one or more forms has been presented for purposes of illustration and description. It is not intended to be exhaustive or limiting to the precise form disclosed. Modifications or variations are possible in light of the above teachings. The one or more forms were chosen and described in order to illustrate principles and practical application to thereby enable one of ordinary skill in the art to utilize the various forms and with various modifications as are suited to the particular use contemplated. It is intended that the claims submitted herewith define the overall scope.

What is claimed is:

1. A spool valve assembly for use downhole to control fluid flow into a borehole from a downhole formation, comprising:

a valve body comprising an interior; and a spool moveable within the valve body interior from a first position wherein the spool prevents flow through the valve body, to a second position wherein the spool allows flow through the valve body at a first flow rate, and to a third position wherein the spool allows flow through the valve body at a second flow rate different than the first flow rate, wherein the spool is moveable from the first position to the second position using hydrostatic fluid pressure acting on the spool from outside the valve body, and wherein the spool is moveable from the second position to the third position using gas pressure from a chemical reaction producing a force sufficient to overcome the hydrostatic pressure.

2. The spool valve assembly of claim 1, wherein the second flow rate is less than the first flow rate.

3. The spool valve assembly of claim 1, further comprising:

the valve body further comprising an inlet port, a first exit port allowing fluid flow at the first flow rate, and a second exit port allowing fluid flow at the second flow rate, wherein in a first position, the spool prevents flow through both the first and second exit ports, wherein in the second position, the spool allows fluid flow from the inlet port only through the first exit port, and wherein in the third position, the spool allows fluid flow from the inlet port only through the second exit port.

4. The spool valve assembly of claim 3, further comprising:

the spool separating the interior into a reactive fluid chamber, an interior chamber, and an open chamber, the open chamber being open to the hydrostatic pressure; and a reactive metal enclosure, the interior of which is a reactive metal chamber in fluid communication with the reactive fluid chamber through a reactive fluid channel, a reactive metal being located in the reactive metal chamber, wherein the spool is movable to the second position upon the hydrostatic pressure acting on the spool through the open chamber, which transfers a reactive fluid in the reactive fluid chamber into the reactive metal chamber, and wherein the spool is movable to the third position upon the reactive metal chemically reacting with the reactive fluid to produce a gas at a pressure communicated to the reactive fluid chamber sufficient to overcome the hydrostatic pressure acting on the spool.

5. The spool valve assembly of claim 4, further comprising a channel valve operable to control fluid flow through the reactive fluid channel.

6. The spool valve assembly of claim 5, wherein the spool is held in the first position by closing the channel valve and preventing the reactive fluid from flowing into the reactive metal chamber.

7. The spool valve assembly of claim 5, wherein the spool is moved to the second position by opening the channel valve and allowing the reactive fluid to flow from the reactive fluid chamber into the reactive metal chamber.

8. The spool valve assembly of claim 5, wherein the channel valve comprises a solenoid valve controllable based on at least one of time, temperature, or pressure.

9. The spool valve assembly of claim 3, wherein the spool valve assembly is connected with a production tubing in the borehole and operable to:

maintain the spool in the first position to prevent fluid flow though the spool valve assembly and into the production tubing or out into the downhole formation;

move the spool into the second position to allow fluid flow from inside the production tubing out of the spool valve assembly or from the downhole formation into the production tubing at the first flow rate; and move the spool into the third position to allow fluid flow from inside the production tubing out of the spool valve assembly or from the downhole formation into the production tubing at the second flow rate.

10. A method of controlling fluid flow into a borehole from a downhole formation, the method comprising:

installing a spool valve assembly downhole in the borehole, the spool valve assembly comprising a valve body comprising an interior and a spool moveable within the valve body interior;

maintaining the spool in a first position to prevent fluid flow through the spool valve assembly;

moving the spool to a second position using hydrostatic pressure acting on the spool from outside of the valve body to allow fluid flow through the spool valve assembly at a first flow rate; and moving the spool to a third position using gas pressure from a chemical reaction producing a force sufficient to overcome the hydrostatic pressure to allow fluid flow through the spool valve assembly at a second flow rate different than the first flow rate.

11. The method of claim 10, wherein the second flow rate is less than the first flow rate.

12. The method of claim 10, further comprising:

preventing fluid flow through first and second exit ports of the valve body with the spool in the first position;

allowing fluid flow into the valve body through an inlet port of the valve body and out of the valve body only through the first exit port with the spool in the second position; and allowing fluid flow into the valve body through the inlet port and out of the valve body only through the second exit port with the spool in the third position.

13. The method of claim 12, further comprising:

separating the interior into a reactive fluid chamber, an interior chamber, and an open chamber with the spool, the open chamber being open to the hydrostatic pressure;

transferring a reactive fluid in the reactive fluid chamber into a reactive metal chamber in fluid communication with the reactive fluid chamber through a reactive fluid channel by moving the spool to the second position; and chemically reacting the reactive fluid with a reactive metal in the reactive metal chamber to produce a gas at a pressure communicated to the reactive fluid chamber sufficient to overcome the hydrostatic pressure acting on the spool to move the spool to the third position.

14. The method of claim 13, further comprising operating a channel valve to control fluid flow through the reactive fluid channel.

15. The method of claim 14, further comprising holding the spool in the first position by closing the channel valve and preventing the reactive fluid from flowing into the reactive metal chamber.

16. The method of claim 14, further comprising moving the spool to the second position by opening the channel valve and allowing the reactive fluid to flow from the reactive fluid chamber into the reactive metal chamber.

17. The method of claim 14, wherein the channel valve comprises a solenoid valve controllable based on at least one of time, temperature, or pressure.

18. The method of claim 12, further comprising:

installing the spool valve assembly to a production tubing in the borehole;

maintaining the spool in the first position to prevent fluid flow though the spool valve assembly and into the production tubing or out into the downhole formation;

moving the spool into the second position to allow fluid flow though the spool valve assembly and into the production tubing or out into the downhole formation at the first flow rate; and moving the spool into the third position to allow fluid flow though the spool valve assembly and into the production tubing or out into the downhole formation at the second flow rate.

19. A system for injecting fluids into and producing fluids from a downhole formation through a borehole extending through the formation, comprising:

a production tubing in the borehole;

a spool valve assembly connected with the production tubing and comprising:

a valve body comprising an interior; and a spool moveable within the valve body interior from a first position wherein the spool prevents flow through the spool valve assembly and into the production tubing or out into the downhole formation, to a second position wherein the spool allows fluid flow though the spool valve assembly and into the production tubing or out into the downhole formation at a first flow rate, and to a third position wherein the spool allows fluid flow though the spool valve assembly and into the production tubing or out into the downhole formation at a second flow rate different than the first flow rate, wherein the spool is moveable from the first position to the second position using hydrostatic fluid pressure acting on the spool from outside the valve body, and wherein the spool is moveable from the second position to the third position using gas pressure from a chemical reaction producing a force sufficient to overcome the hydrostatic pressure.

20. The system of claim 19, further comprising:

the spool separating the interior into a reactive fluid chamber, an interior chamber, and an open chamber, the open chamber being open to the hydrostatic pressure; and a reactive metal chamber in fluid communication with the reactive fluid chamber through a reactive fluid channel, a reactive metal being located in the reactive metal chamber, wherein the spool is movable to the second position upon the hydrostatic pressure acting on the spool through the open chamber, which transfers a reactive fluid in the reactive fluid chamber into the reactive metal chamber, and wherein the spool is movable to the third position upon the reactive metal chemically reacting with the reactive fluid to produce a gas at a pressure communicated to the reactive fluid chamber sufficient to overcome the hydrostatic pressure acting on the spool.

* * * * *